United States Patent [19]

Ferraro

[11] Patent Number: 4,693,003

[45] Date of Patent: Sep. 15, 1987

[54] PIVOTABLE RAZOR CARTRIDGE WITH CIRCULAR CAM

[75] Inventor: Frank A. Ferraro, Trumbull, Conn.

[73] Assignee: Warner Lambert Company, Morris Plains, N.J.

[21] Appl. No.: 908,079

[22] Filed: Sep. 15, 1986

[51] Int. Cl.[4] ..... B26B 21/00

[52] U.S. Cl. ..... 30/50; 30/57; 30/89

[58] Field of Search ..... 30/50, 57, 89

[56] References Cited

U.S. PATENT DOCUMENTS 4,026,016 5/1977 Nissen ..... 30/50

*Primary Examiner*—Douglas D. Watts

*Attorney, Agent, or Firm*—Howard Olevsky; Stephen Raines

[57] ABSTRACT

According to this invention, a pivotally mounted cartridge is provided having pivotal attachment means at or near either end of the cartridge and arcuate cam means which replace the V-shaped cam to provide a pivoting razor wherein the biasing forces are essentially even throughout the arc of the pivot. The balancing of biasing forces result in maintaining the cartridge orientation relative to the face after the initial orientation has been established.

3 Claims, 2 Drawing Figures

8
30
16
16
30
13
12
14
18
18
10
15
15
12
13
18
18
29
24
23
24
40
42
24
23'
24
28
2
2
20
22
21
42'
41
21'
22'

20
42'
40
41
42

PIVOTABLE RAZOR CARTRIDGE WITH CIRCULAR CAM

FIELD OF THE INVENTION

This invention relates to a razor with a pivoting cartridge and particularly to a cartridge having a modified cam.

BACKGROUND OF THE INVENTION

Razors with pivoting blade units are well known in the art and, in fact, the concept extends back more than 50 years. The rationale behind the recent generation of pivoting cartridge razors is that when the razor is used the blade assembly responds to shaving forces pivots to provide a shaving angle of skin to blade which is constant throughout the shave. Examples of pivoting cartridge patents are set out below.

U.S. Pat. No. 3,938,247 to Carbonell, et al. issued Feb. 17, 1976 discloses a razor handle with a convex-concave combination which pivots in response to shaving forces when an otherwise stationary cartridge is attached.

U.S. Pat. No. 3,935,639 issued to Terry, et al. on Feb. 3, 1976 describes an arcuately convex cartridge which slides along mating guard rails attached to a concave extension of a razor handle. This assembly includes biasing means which directs the cartridge towards a "neutral" center position between the pivoting extremes.

U.S. Pat. No. 4,403,414 issued Sept. 13, 1983 to Kiraly and Ortiz describes a razor in which the handle forms a concave seat and the cartridge rotates within the seat.

U.S. Pat. No. 4,152,828 issued May 8, 1979 to Lund describes an off-center universal joint on the handle designed to mate with a suitable receptacle on a cartridge and is biased to automatically resume a neutral position between the extreme pivot range of the joint.

U.S. Pat. No. 4,253,235 issued to Jacobson on Mar. 3, 1981 describes cams disposed on journal arms extending outward from a razor handle for providing biasing action for a pivotal cartridge assembly.

U.S. Pat. Nos. 4,282,650 and 4,282,651 issued to Trotta on Aug. 11, 1981 describe a pivotal cartridge featuring a centrally mounted pivot bar which is attached to a razor handle by a sliding gate.

U.S. Pat. No. 4,057,896 issued Nov. 15, 1977 to Trotta discloses a razor cartridge which is joined to a razor handle by pivotal bearing means with the bearings positioned near either end of the bottom of the cartridge. Positioned between the pivotal bearing means on the cartridge is a complex cam surface consisting of two oppositedly inclined surfaces intersecting to form a dihedral angle. This cam is tracked by a cam follower on the handle which is biased by means of oppositedly disposed flexible cam arms positioned on either side of the central cam arm.

U.S. Pat. Nos. 4,083,104 issued Apr. 11, 1978 to Nissen and 4,026,016 issued May 31, 1977 also to Nissen disclose a razor cartridge such as that depicted in Trotta U.S. Pat. No. 4,057,896. Also disclosed therein is the configuration for the razor cartridge which have been commercially successful. This cartridge, rather than having the complex multi-faceted cam face of Trotta features a V-shaped profile with a flat surface which is engaged by a biased bullet shaped cam follower extending from the handle when the cartridge is attached. This combination along with others in the prior art utilizes the biasing force of a cam follower in a handle to direct the cartridge towards a neutral, i.e., center position between the extremes of the pivot arc formed by the cartridge during shaving. When the razor is removed from the face the force exerted against the bias is also removed and the orientation of the cartridge then returns to one in which the cam followers positioned in the joint of the V-shaped cam. This biasing center return is objectionable to many shavers who might otherwise prefer to change the cartridge orientation during shaving because there is no establishment of the changed orientation with a series of strokes. The user is, as a result, constantly positioning the razor against the bias rather than having once established a suitable shaving position having that position maintained throughout the shaving operation.

SUMMARY OF THE INVENTION

According to this invention, a pivotally mounted cartridge is provided having pivotal attachment means at or near either end of the cartridge and arcuate cam means which replace the V-shaped cam to provide a pivoting razor wherein the biasing forces are essentially even throughout the arc of the pivot. The balancing of biasing forces result in maintaining the cartridge orientation relative to the face after the initial orientation has been established.

DETAILED DESCRIPTION OF THE INVENTION

Figure 1:
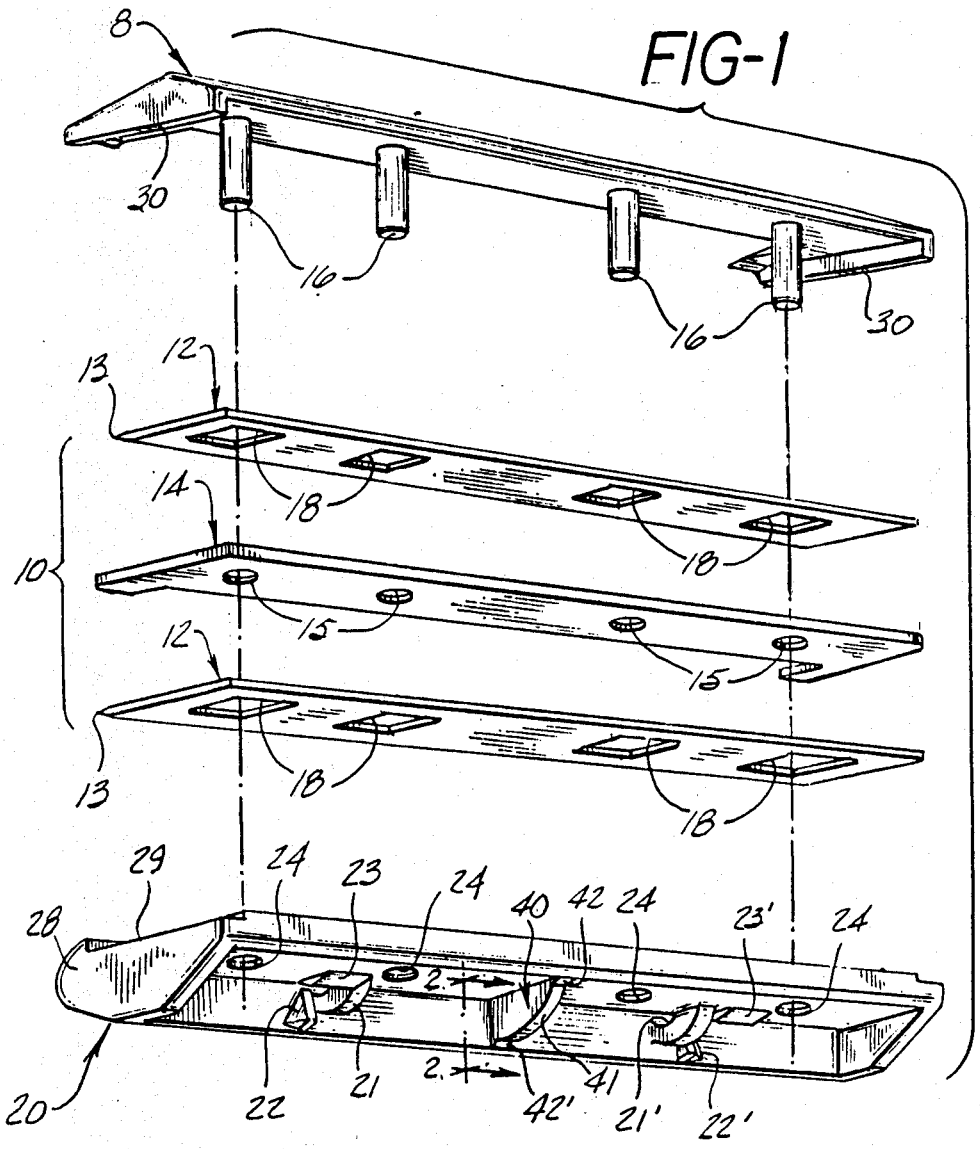
FIG. 1 is an exploded perspective view shown from the bottom of a cartridge according to this invention.
Figure 2:
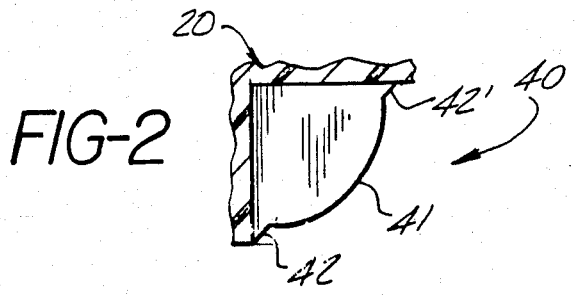
FIG. 2 is an enlarged cross-sectional view of the cam taken along line 2—2 of FIG. 1.

An exploded view of a conventional cartridge is depicted in FIG. 1 in which a cartridge having two blades 12 with edges 13 is separated by a spacer 14 to define a cutting system 10. Cap 8 has a series of four stakes 16 which extend through the blade subassembly 10 through openings defined by elongated slots 18 in blade 12 and essentially symmetrical circular openings 15 in spacer 14 the stakes extend downward into receptacles 24 in blade seat 20. When the cartridge is completely assembled flanges 30 of cap 8 are spaced above undercut portions 29 of the seat member 20. The cap and seat are transversely longer than the blade subassembly and the mating of flange 30 and undercut ledge 29 surround the side edges of the cutting system 10 to prevent user contact with the blade sides.

The bottom surface of seat 20 features stop means 22, 22', and 23, 23' positioned slightly outboard of journal bearing means 21, 21'. Journal bearing means 21, 21' engage journaling faces of razor handle arms to maintain attachment between the handle and the cartridge and also provide for a pivoting motion. Stops 22, 22' and 23, 23' define the limit of the pivot arc. The razor cartridge described above is conventional and well known in the art and either the blade subassembly, the cap or the attachment means for assembling the cartridge nor the journal or stop on the bottom face of the cartridge are unique to this invention.

Cam 40 having cam surface 41 defines a track in which the cam follower of the razor handle moves. Contrary to prior art cams, this cam is outwardly arcuate in configuration and provides a flat face for the bullet-shaped cam follower of the razor handle to travel along. Stops 42, 42' are provided on the cam to define the length of of arc of the cam surface. By providing a cam with an outwardly arcuate travel path for the cam follower and a small radius of curvature, movement of the pivoting cartridge after attachment to the handle and in response to shaving forces provides the ultimate position of orientation for the blades themselves. When the user applies a shaving stroke the orientation of the cartridge changes in response to the stroke. Contrary to the conventional V-shaped cam previously employed in cartridges, when the razor is lifted from the face, there is no biasing force directing the cartridge back to a central, i.e., neutral position in the pivoting arc. As a result, when the user shaves a first stroke and returns after lifting the razor from his face for a second stroke the orientation of the cartridge does not change in response to the elimination of resistance of the face to the biasing means applied to the cam.

Radius of curvature value is between about 0.05 and about 0.120 in. define an optimum range for cam radius which is particularly suited for elimination of biasing forces directed towards cartridge return. Greater radii of curvature will provide a greater biasing force. Smaller radii of curvature will reduce the pivot arc.

One of the important features of the cam of this invention is that it can be utilized with cartridges which are identical to the V-cam cartridge in every other way and can be engaged by razor handles currently available having biased cam followers design to engage cartridge with V-shaped cams. These features mean that no substantial retooling or reinvestment is involved in the commercial utilization of the cartridge having the unique cam described above.

I claim:

1. A cartridge for a pivoting head razor said razor including a razor handle, said razor handle including means for pivotally attaching said cartridge and biased cam follower means, said cartridge comprising in combination:

(a) at least one blade having a blade edge;

(b) a cap overlaying said blade;

(c) a blade seat for supporting said blade;

(d) a guard bar extending outward beyond the exposed blade edge from said seat; and (e) means for joining said blade, seat and cap in a predetermined spatial relationship, with said blade seat having a bottom profile with a substantially rectangular perimeter, said profile including pivotable attachment means for engaging said handle positioned at or near each cartridge end, and a cam which is arcuate in cross-section positioned between said attachment means, said cam having a single flat face with continuous outward curve defining a single cam follower track along the entire extent of the cam, said cartridge maintaining the orientation obtained during shaving after the cartridge is removed from the face due to the lack of biasing force to direct the cam back to a central position.

2. The cartridge of claim 1 wherein a second blade is included which is maintained in a spaced relationship from said first blade.

3. The cartridge of claims 1 or 2 wherein the radius of curvature of said cam face is between about 0.05 and about 0.120 in.

* * * * *